US011517117B1

(12) United States Patent
Sun

(10) Patent No.: US 11,517,117 B1
(45) Date of Patent: Dec. 6, 2022

(54) SOFA

(71) Applicant: JINGNING MEIGE OPERATION MANAGEMENT CO., LTD, Lishui (CN)

(72) Inventor: Jiada Sun, Ningbo (CN)

(73) Assignee: JINGNING MEIGE OPERATION MANAGEMENT CO., LTD, Lishui (CN)

( * ) Notice: Subject to any disclaimer, the term of this patent is extended or adjusted under 35 U.S.C. 154(b) by 0 days.

(21) Appl. No.: 17/746,896

(22) Filed: May 17, 2022

(30) Foreign Application Priority Data

Apr. 21, 2022 (CN) ..... 202220931344.4

(51) Int. Cl.
*A47C 17/04* (2006.01)

(52) U.S. Cl.
CPC ..... *A47C 17/04* (2013.01)

(58) Field of Classification Search
CPC ..... A47C 17/04; A47C 13/005
USPC ..... 297/440.14
See application file for complete search history.

(56) References Cited

U.S. PATENT DOCUMENTS

| | | | | |
|---|---|---|---|---|
| 3,973,800 | A * | 8/1976 | Kogan | A47C 13/005 297/135 |
| 6,241,317 | B1 * | 6/2001 | Wu | A47C 4/02 297/440.1 |
| 7,252,339 | B2 * | 8/2007 | Owens | A47C 7/42 297/440.16 |
| 10,070,725 | B2 * | 9/2018 | Nelson | A47C 4/028 |
| 10,123,621 | B2 * | 11/2018 | Nelson | A47C 13/005 |
| 11,297,949 | B1 * | 4/2022 | Galjour | A47C 4/028 |
| 2007/0257539 | A1 * | 11/2007 | White, III | A47C 17/045 297/440.14 |

* cited by examiner

*Primary Examiner* — Mark R Wendell

(57) ABSTRACT

A sofa includes a sofa seat and a sofa seat accessory. The sofa seat includes a seat frame, a first outer wrapping, and first snap buckles. The first outer wrapping wraps the seat frame. The first snap buckles are disposed on at least one side of the seat frame. The sofa seat accessory is configured to be detachably mounted on the sofa seat. The sofa seat accessory includes an accessory frame, a second outer wrapping, and second snap buckles disposed on the accessory frame. When the sofa seat accessory is mounted to the sofa seat, each of the second snap buckles is matched to each of the first snap buckles to form a quick connection between the sofa seat and the sofa seat accessory.

9 Claims, 12 Drawing Sheets

SOFA

TECHNICAL FIELD

The present disclosure relates to a technical field of home decoration, and in particular to a sofa.

BACKGROUND

Modular sofas have become a trend on market since the modular sofas are more convenient to transport and are easy to be installed by users at home.

Taking outdoor rattan modular sofas on market as an example, a plurality of screws are provided for most of the outdoor rattan modular sofas to realize modular installation. Due to a fact that the number of the screws is large, each of the outdoor rattan sofa takes an average time of more than one hour to install, which is difficult to install and requires professional tools (screwdrivers, guns, etc. and is very easy to have a lack of accessories, and after-sales service requires sellers to mail a large number of accessories for support, so that the after-sales service has a high cost. In addition, a product packaging volume of the outdoor rattan sofas is large, which results in high transportation cost.

Although screw installation of the modular sofas has low technical threshold, and the plurality of the screws are all purchased. However, under a condition that the plurality of the screws are required for installation, it is meant that there are many holes that need to be punched during production of the modular sofas, which is easy to dislocate, so that labor cost is increased.

SUMMARY

The present disclosure provides a sofa, which achieves rapid installation of the sofa and reduces production cost.

The present disclosure provides the sofa, including a sofa seat and a sofa seat accessory. The sofa seat includes a seat frame, a first outer wrapping, and first snap buckles. The first outer wrapping wraps the seat frame. The first snap buckles are disposed on at least one side of the seat frame.

The sofa seat accessory is configured to be detachably mounted on the sofa seat. The sofa seat accessory includes an accessory frame, a second outer wrapping, and second snap buckles disposed on the accessory frame. When the sofa seat accessory is mounted to the sofa seat, each of the second snap buckles is matched to each of the first snap buckles to form a quick connection between the sofa seat and the sofa seat accessory.

Optionally, the seat frame of the sofa seat includes a first side frame, and the first side frame is disposed on one side of the seat frame. The first snap buckles are disposed on the first side frame. The sofa seat accessory includes a first accessory. The first accessory includes a first accessory frame and the second snap buckles disposed on the first accessory frame. The first accessory is connected to the first snap buckles on the first side frame through the second snap buckles.

Optionally, the first side frame includes a first transverse support, a first vertical support, and a second vertical support. The first transverse support is distal from a bottom of the sofa seat. The first vertical support and the second vertical support are respectively disposed at two ends of the first transverse support and are vertically disposed relative to the first transverse support. The first snap buckles are disposed on the first vertical support and/or the second vertical support.

Optionally, a second transverse support is disposed at a position, with respect to the first transverse support, of the first accessory frame. At least one hook is disposed on the first transverse support, at least one socket is defined on the second transverse support, and when the first accessory is connected to the sofa seat, the at least one hook is inserted into the at least one socket.

Optionally, the first side frame is an inverted U-shaped structure composed of the first transverse support, the first vertical support, and the second vertical support. One side, with respect to the bottom of the sofa seat, of the first side frame is in an opening structure.

Optionally, a first accommodating space is defined in the seat frame. The first accommodating space is defined with respect to a shape of the sofa seat accessory, and the first accommodating space accommodates at least one sofa seat accessory.

Optionally, the seat frame further includes a second side frame. The second side frame is adjacent to the first side frame and is disposed at an included angle with the first side frame. The first snap buckles are disposed on the second side frame. The sofa seat accessory includes a second accessory. The second accessory includes a second accessory frame and the second snap buckles disposed on the second accessory frame. The second accessory is disposed on the second side frame of the sofa seat through the second snap buckles on the second accessory.

Optionally, fifth snap buckles are disposed on the first accessory frame, sixth snap buckles are disposed on the second accessory frame, and the first accessory frame and the second accessory frame are detachably and rapidly connected through the fifth snap buckles and the sixth snap buckles.

Optionally, the sofa further includes a tea table assembly. The tea table assembly includes a U-shaped main frame and auxiliary frames disposed on two sides of the U-shaped main frame. Seventh snap buckles and positioning holes are respectively disposed and defined on the U-shaped main frame. Eighth snap buckles and positioning pins are disposed on the auxiliary frames. The U-shaped main frame and the auxiliary frames are detachably connected through the seventh snap buckles, the eighth snap buckles, the positioning holes, and the positioning pins.

Optionally, the sofa further includes a seat cushion, and a second accommodating space is defined in the accessory frame for accommodating the seat cushion.

In one embodiment of the present disclosure, the first snap buckles are disposed on at least one side of the seat frame of the sofa seat, the second snap buckles are disposed on the accessory frame of the sofa seat accessory, and when the sofa seat accessory is mounted to the sofa seat, each of the second snap buckles is matched to each of the first snap buckles to form a quick connection between the sofa seat and the sofa seat accessory. Compared with a conventional assembling method using screws, the embodiment of the present disclosure has fewer components, and the installation is more convenient and faster. At the same time, during production and assembly, the embodiment of the present disclosure reduces arrangement of holes and number of the components, and further reduces the production costs.

In another embodiment, the first accommodating space is further defined in the sofa seat for accommodating the sofa seat accessory. During packaging and transportation, the sofa seat accessory is disposed in the first accommodating space, which reduces a whole packaging volume.

In another embodiment, the second accommodating space is further defined in the sofa seat accessory. During the packaging and the transportation, the seat cushion is plugged into the second accommodating space, which further reduces the whole packaging volume.

BRIEF DESCRIPTION OF DRAWINGS

In order to more clearly illustrate technical solutions in embodiments of the present disclosure, drawings required in description of the embodiments are briefly described below. Obviously, the drawings in the following description are merely some embodiments of the present disclosure, and for a person skilled in art, other drawings may be obtained according to these drawings without creative efforts.

For a more complete understanding of the present disclosure and beneficial effects thereof, the following description is made with reference to the accompanying drawings, wherein same reference numerals refer to same parts in the following description.

DETAILED DESCRIPTION

Technical solutions in embodiments of the present disclosure are clearly and completely described below with reference to accompanying drawings in the embodiments of the present disclosure. Obviously, the described embodiments are only a part of the embodiments of the present disclosure, rather than all of the embodiments. All other embodiments obtained by a person skilled in art based on the embodiments of the present disclosure without creative efforts shall fall within a protection scope of the present disclosure.

Figure 1:
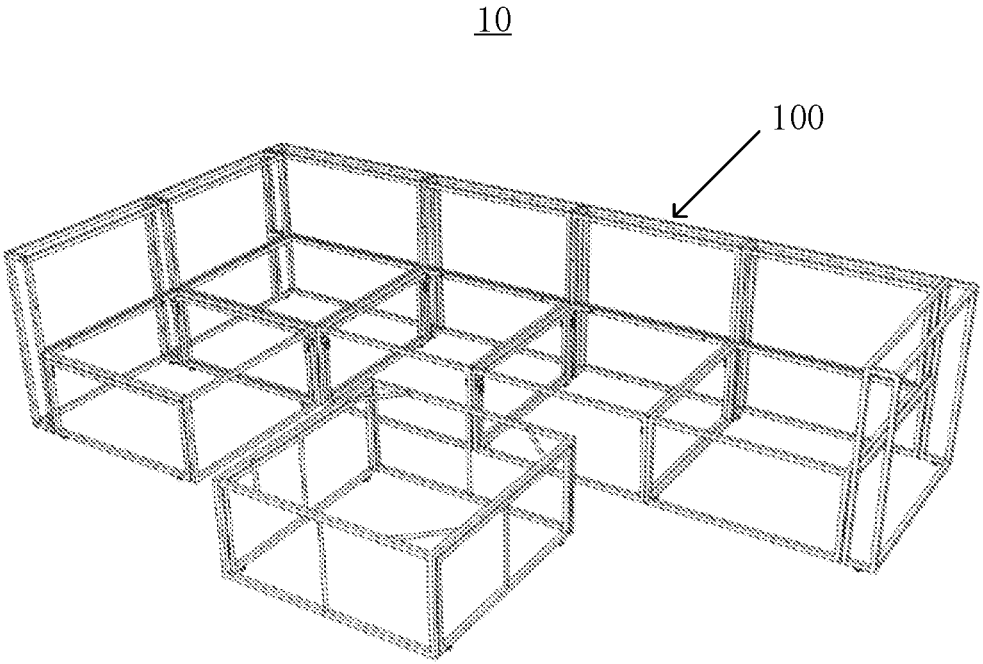
FIG. 1 is an assembly structural schematic diagram of a sofa according to an embodiment of the present disclosure where an outer wrapping is not shown.

One embodiment of the present disclosure provides a sofa 10, and specifically refer to FIG. 1, FIG. 1 shows a frame of the sofa 10 of the present disclosure and further shows assembly of the sofa 10 according to the embodiment of the present disclosure. The sofa 10 includes a plurality of modular units 100. The plurality of the modular units are combined into a required number of seats or structural forms according to requirements, for example, two-person positions and three-person positions in a straight row, or four-person positions or five-person positions set using a corner, or even more person positions, which are combined according to the requirements.

As shown in FIGS. 2-7, FIGS. 2-7 are respectively a structural schematic diagram, an exploded schematic diagram, and a mounting schematic diagram of one of the modular units 100 in the embodiment of the present disclosure, and the one of the modular units 100 includes a sofa seat 3 and a sofa seat accessory 2. The sofa seat 3 includes a seat frame 30, a first outer wrapping (not shown in FIG. 1), and first snap buckles 41. The first outer wrapping wraps the seat frame 30. The first snap buckles 41 are disposed on at least one side of the seat frame 30. The sofa seat accessory 2 is configured to be detachably mounted on the sofa seat 3. The sofa seat accessory 2 includes an accessory frame 20, a second outer wrapping (not shown in the figures), and second snap buckles 42 disposed on the accessory frame 20. When the sofa seat accessory 2 is mounted to the sofa seat 3, each of the second snap buckles 42 is matched to each of the first snap buckles 41 to form a quick connection between the sofa seat 3 and the sofa seat accessory 2. Compared with a conventional way of using screws to install the sofa, the embodiment adopts a connection method of the snap buckles, and the connection between the sofa seat accessory 2 and the sofa seat 3 only needs to be in a good position. A fixing is realized through a mutual insertion and cooperation of the second snap buckles 42 and the first snap buckles 41. The embodiment of the present disclosure requires few components, has a fast installation speed and a simple installation method.

In the embodiment, the first outer wrapping of the seat frame 30 and the second outer wrapping of the accessory frame 20 may be similar braided fabric packages such as rattan, bamboo, and the like, and may further be other textile packages, or a combination of a braid and a textile, etc.

In the embodiment, the seat frame 30 and the accessory frame 20 may be formed through welding a metal tubular member, and may further be formed through means of shearing bending.

Figure 13:
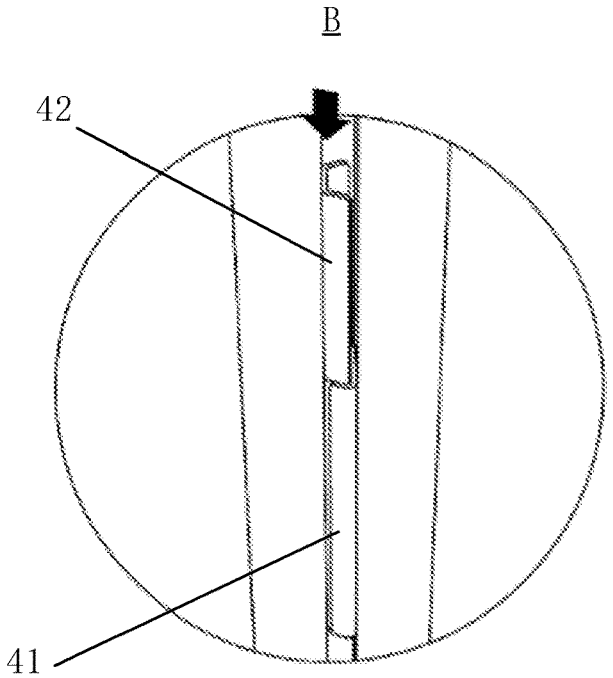
FIG. 13 is an enlarged schematic diagram of portion B shown in FIG. 4.

As shown in FIGS. 8-11, a structural form of one of the first snap buckles 41 and one of the second snap buckles 42 is shown in FIGS. 8-9, and FIGS. 10-11 are schematic diagrams of an insertion process and a state after the insertion of one of the first snap buckles 41 and one of the second snap buckles 42, respectively. Each of the first snap buckles 41 includes a first mounting portion 411, first limiting portions 412, a second limiting portion 413, and an insertion port 414. The first mounting portion 411 is configured to fix to the seat frame 30, the first limiting portions 412 are connected to two sides of the first mounting portion 411, the second limiting portion 413 is disposed at a first end of the first mounting portion 411, and the insertion port 414 is disposed at a second end of the first mounting portion 411. The first mounting portion 411 is mounted to the seat frame 30 through the screws (not shown in the figures). The first mounting portion 411, the first limiting portions 412, and the second limiting portion 413 enclose an insertion space 415. And from the insertion port 414 toward the second limiting portion 413, the first limiting portions 412 on the two sides are compressed into the insertion space 415, so that the insertion space 415 is gradually reduced. In one embodiment, the first mounting portion 411, the first limiting portions 412, and the second limiting portion 413 are formed through integrally pressing a mold or integrally bending a plate member. Each of the second snap buckles 42 includes a second mounting portion 421 and third limiting portions 422. The second mounting portion 421 is configured to mount to the accessory frame 20. The third limiting portions 422 are connected to two sides of the second mounting portion 421 and limited to the first limiting portions 412. The second mounting portion 421 is mounted to the accessory frame 20 through the screws. Outer surfaces of the second mounting portion 421 and the third limiting portions 422 form a column structure adapted to the insertion space 415. As shown in FIG. 13, when installing the sofa seat accessory 2, aligning one of the second snap buckles 42 with one of the first snap buckles 41 for insertion. After the one of the second snap buckles 42 is inserted into the one of the first snap buckles 41, limiting of a plurality of directions other than an insertion direction is formed. In one embodiment, the second mounting portion 421 and the third limiting portions 422 are formed through integrally pressing the mold or integrally bending the plate member.

In the embodiment, an assembled thickness of the one of the first snap buckles 41 and the one of the second snap buckles 42 is achieved within a range of 7 mm. A thickness of the one of the first snap buckles 41 in a structure of the embodiment is 6 mm, which meets a range requirement of less than 7 mm to 12 mm in a safety specification. In addition, the first snap buckles 41 and the second snap buckles 42 are lengthened in a vertical direction, meanwhile, a thickness of an iron sheet is increased in a transverse direction. After installation, the embodiment is more secure than a conventional screw fixing method.

It should be noted that the structural form of the one of the first snap buckles 41 and the one of the second snap buckles 42 is not limited to the structural form provided by the embodiment. In the embodiment, the insertion space 415 defined by the one of the first snap buckles 41 is similar to a trapezoidal structure, but does not exclude structure forms of other snap buckles. For example, the insertion space of the one of the first snap buckles 41 may further forms a structure similar to a hexagon, and a shape of the one of the second snap buckles 42 is adapted to the shape of the insertion space. Furthermore, a possibility of increasing elastic buckles on the first snap buckles 41 is not excluded, so that the limiting is further achieved in a reverse direction of the insertion direction.

It should be noted that positions of the first snap buckles 41 and the second snap buckles 42 are interchangeable, that is, the first snap buckles 41 may be disposed on the sofa seat accessory 2, and the second snap buckles 42 may be disposed on the sofa seat 3.

Figure 2:
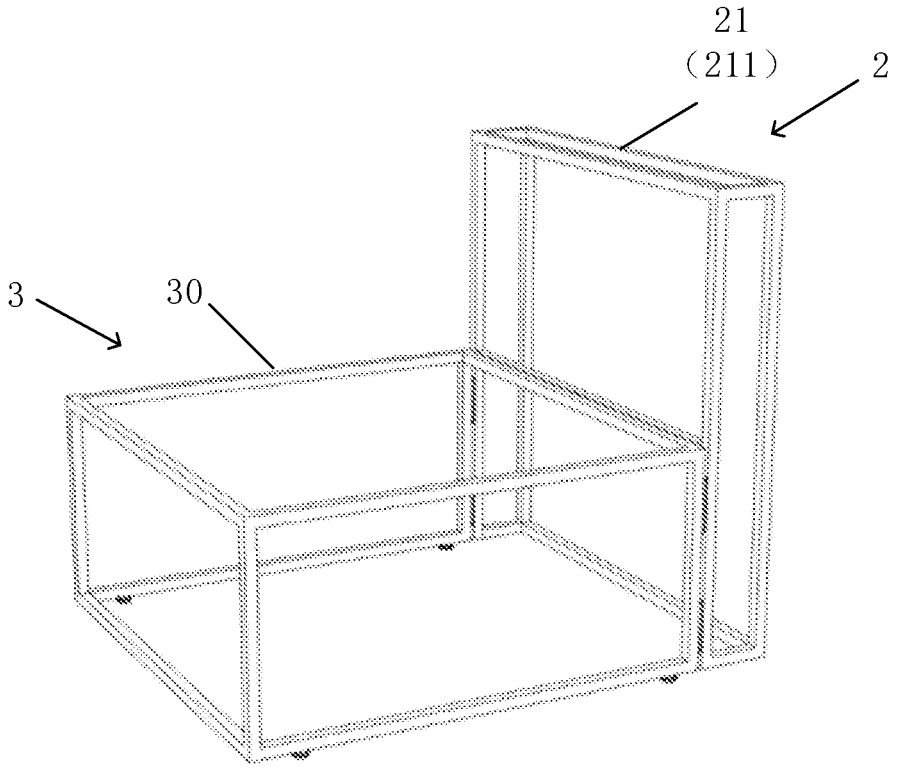
FIG. 2 is a structural schematic diagram of a sofa seat in the sofa shown in FIG. 1 where an armrest structure is not shown.
Figure 3:
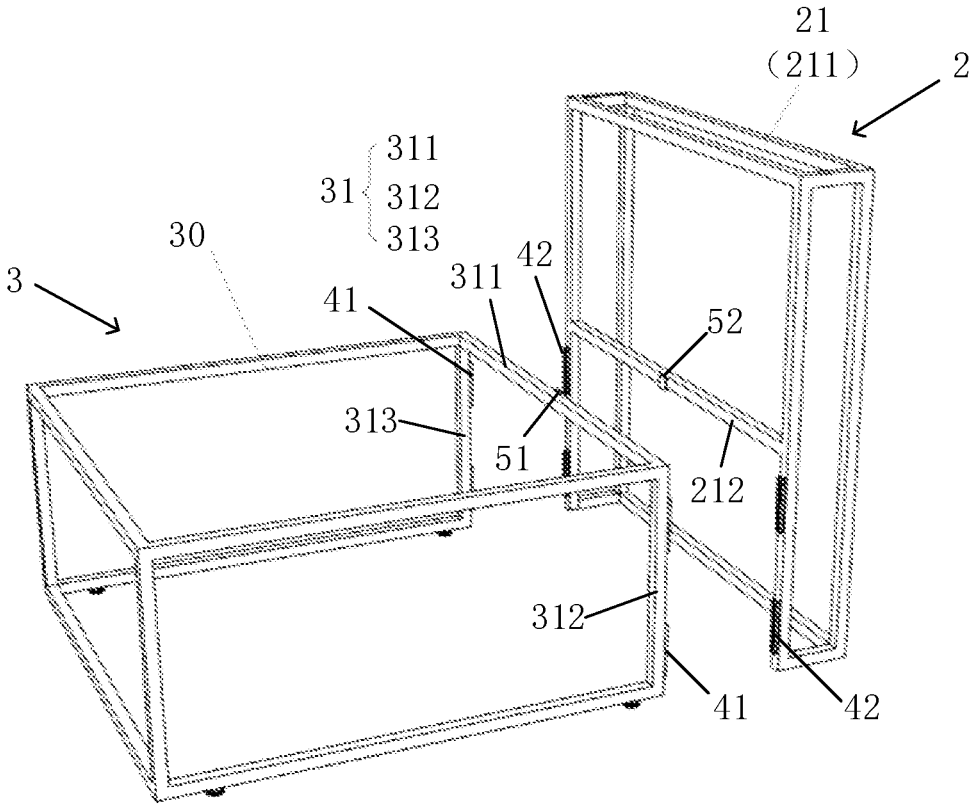
FIG. 3 is an exploded structural schematic diagram of the sofa seat in the sofa shown in FIG. 1 where the armrest structure is not shown.
Figure 4:
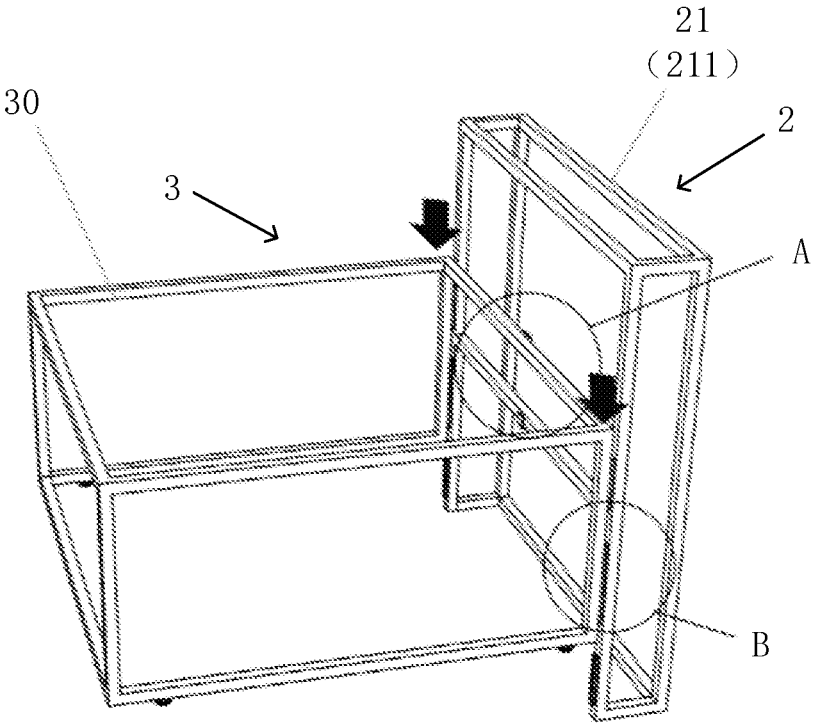
FIG. 4 is a schematic diagram of mounting the sofa seat in the sofa shown in FIG. 1 where the armrest structure is not shown.

Please continue to refer to FIGS. 2-4, as a specific embodiment, the seat frame 30 of the sofa seat 3 includes a first side frame 31, the first side frame 31 is disposed on one side of the seat frame 30, and the first snap buckles 41 are disposed on the first side frame 31. The sofa seat accessory 2 includes a first accessory 21, the first accessory 21 includes a first accessory frame 211 and the second snap buckles 42 disposed on the first accessory frame 211. The second snap buckles 42 are disposed in two rows and two columns, and the first snap buckles 41 correspond to the second snap buckles 42. The first accessory 21 is connected to the first snap buckles 41 on the first side frame 31 through the second snap buckles 42. In one embodiment, the first accessory 21 is configured as a backrest of the sofa, the first accessory 21 is combined with the sofa seat 3 to form a modular unit of the sofa 100, and a multi-person sofa is formed by combining a plurality of the modular units.

It should be noted that the seat frame 30 in the drawings of the embodiment is of a square structure. The first side frame 31 is disposed on the one side of the seat frame 30. However, in some implementations, a shape of the seat frame 30 is not limited to a square structure, and is further circular, polygonal, and other irregular shapes. A frame structure disposed on one side of the first accessory 21 refers to an arrangement of the first snap buckles 41 on the first side frame 31, and is not limited to the structure form of the first side frame 31.

Specifically, the seat frame 30 of the embodiment is described below. The first side frame 31 includes a first transverse support 311, a first vertical support 312, and a second vertical support 313. The first transverse support 311 is distal from a bottom of the sofa seat 3. The first vertical support 312 and the second vertical support 313 are respectively disposed at two ends of the first transverse support 311 and are vertically disposed relative to the first transverse support 311. The first snap buckles 41 are disposed on the first vertical support 312 and/or the second vertical support 313. The first transverse support 311, the first vertical support 312, and the second vertical support 313 are fixed in a welding form, of course, are further connected through screws, and are further integrally bent to form.

Figure 12:
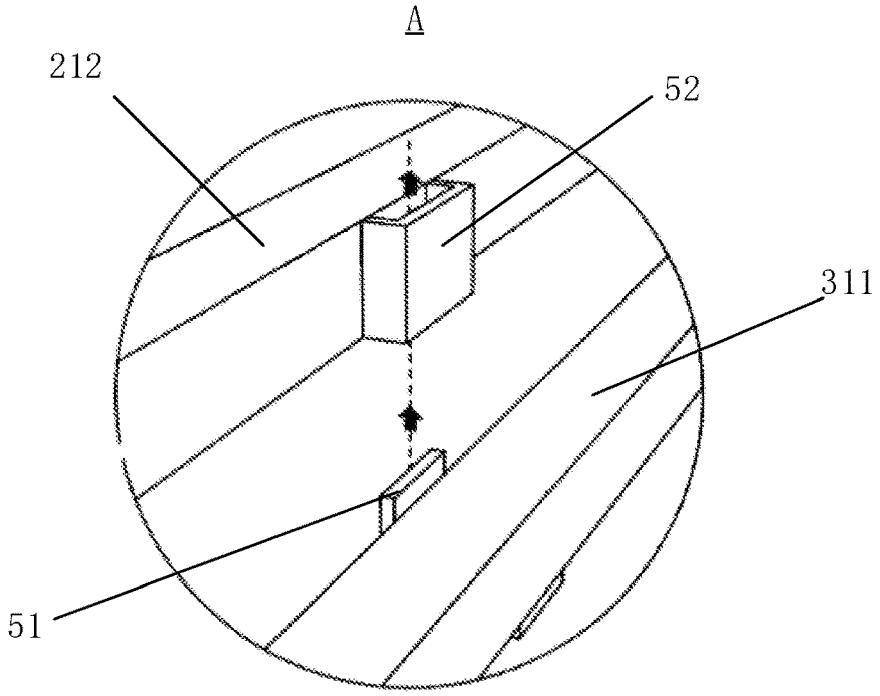
FIG. 12 is an enlarged schematic diagram of portion A shown in FIG. 4.

As a further improvement, please refer to FIG. 12. A second transverse support 212 is disposed at a position, with respect to the first transverse support 311, of the first accessory frame 211. At least one hook 51 is disposed on the first transverse support 311, at least one socket 52 is defined on the second transverse support 212, and when the first accessory 21 is connected to the sofa seat 3, the at least one hook 51 is inserted into the at least one socket 52. Similarly, the positions of the at least one hook 51 and the at least one socket 52 are further interchangeable. An arrangement of the at least one hook 51 and the at least one socket 52 makes a cross surface between the sofa seat 3 and the sofa seat accessory 2 obtain a lateral limit, which further improves a reliability of a connection between the sofa seat accessory 2 and the sofa seat 3, and provides more reliable support when the first accessory 21 is configured as the backrest.

Figure 5:
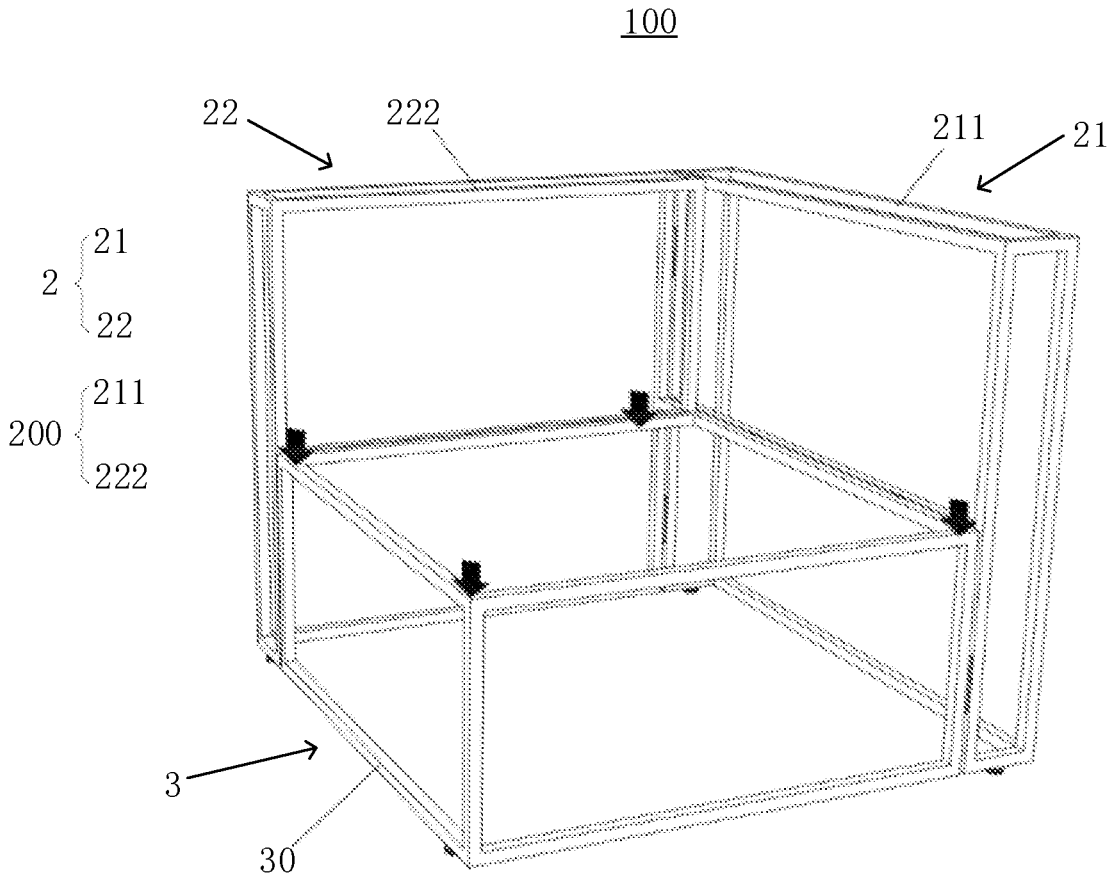
FIG. 5 is a structural schematic diagram of the sofa seat in the sofa shown in FIG. 1 with the armrest structure.
Figure 6:
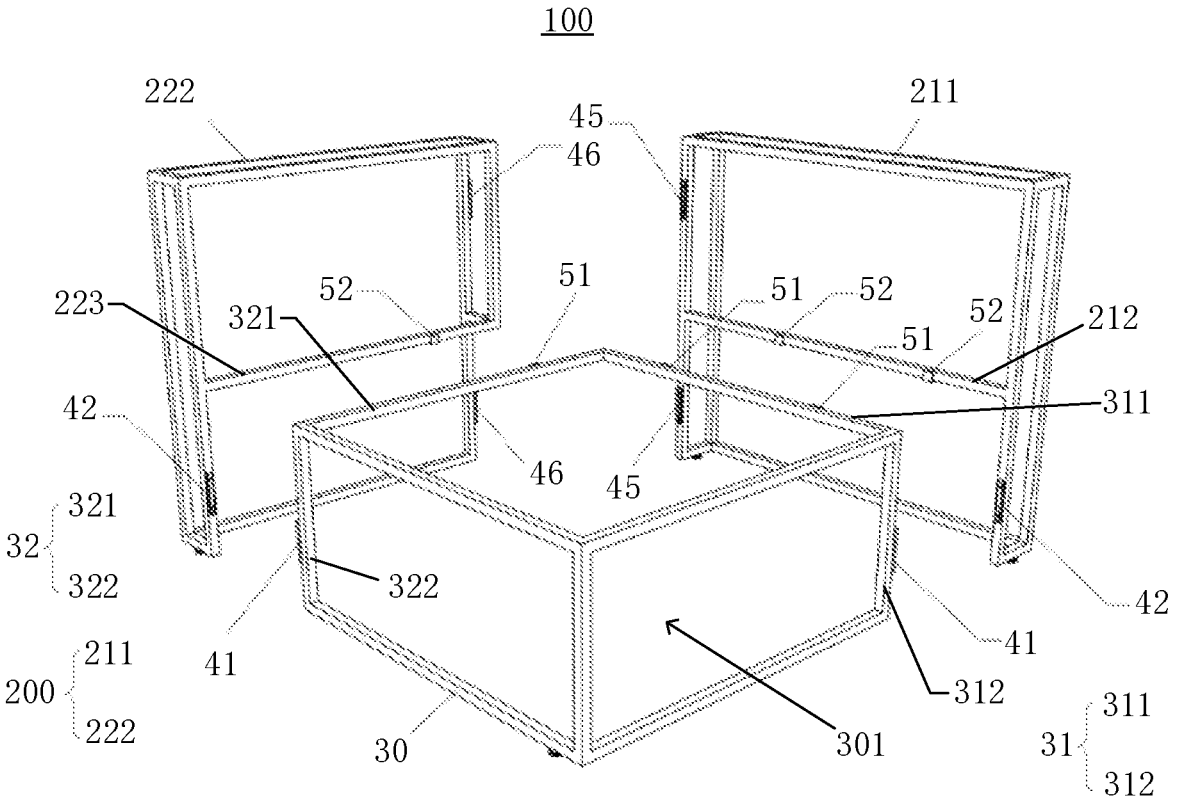
FIG. 6 is an exploded structural schematic diagram of the sofa seat in the sofa shown in FIG. 1 with the armrest structure.
Figure 7:
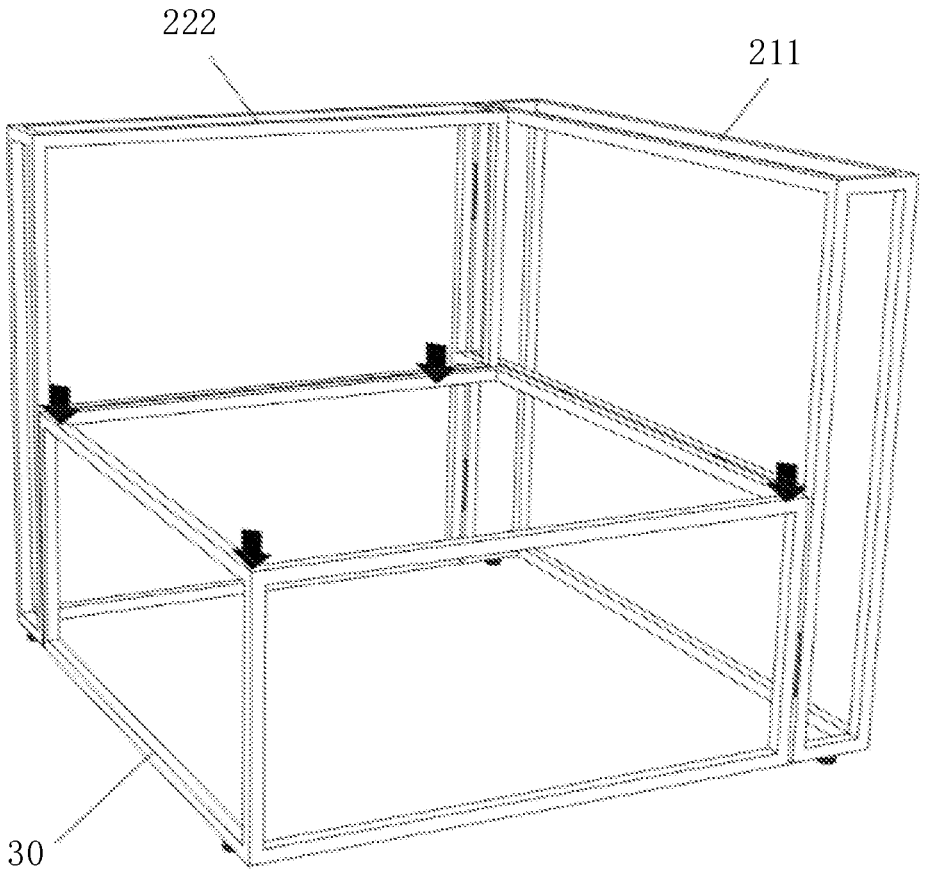
FIG. 7 is a schematic diagram of mounting the sofa seat in the sofa shown in FIG. 1 with the armrest structure.
Figure 8:
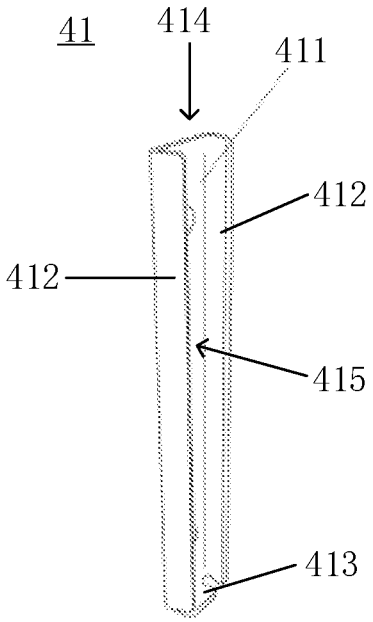
FIG. 8 is a structural schematic diagram of one of first snap buckles according to one embodiment of the present disclosure.
Figure 9:
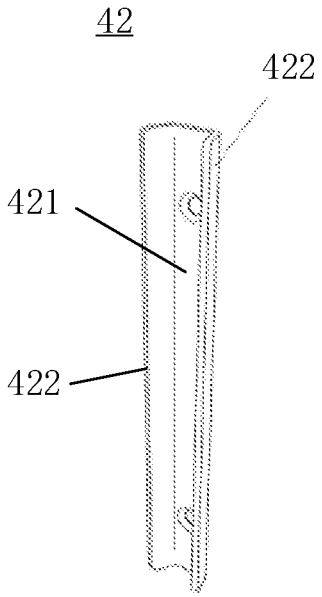
FIG. 9 is a structural schematic diagram of one of second snap buckles according to one embodiment of the present disclosure.
Figure 10:
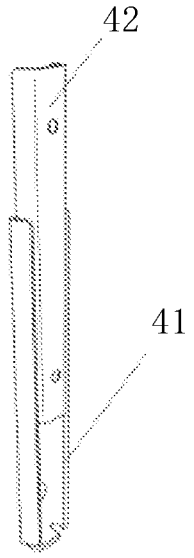
FIG. 10 is a schematic diagram of the one of the first snap buckles and the one of the second snap buckles where the one of the first snap buckles and the one of the second snap buckles are in insertion according to one embodiment of the present disclosure.
Figure 11:
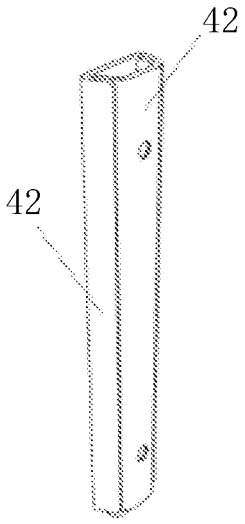
FIG. 11 is a schematic diagram of the one of the first snap buckles and the one of the second snap buckles after insertion according to one embodiment of the present disclosure.

Please continue to refer to FIGS. 5-7, when the modular unit is configured as a corner modular unit or an outermost modular unit of the sofa, the seat frame 30 further includes a second side frame 32, the second side frame 32 is adjacent to the first side frame 31 and is disposed at an included angle with the first side frame 31. In general, the included angle is 90°, however, in some practical implementations, 30°, 60° or 120° are all possible, which is set according to specific requirements. Specifically, the second side frame 32 includes a third transverse support 321 and a third vertical support 322. The third transverse support 321 is bent and connected to the first transverse support 311, and the third vertical support 322 is disposed at one end, distal from the first transverse support 311, of the third transverse support 321. The first snap buckles 41 are further disposed on the second side frame 32, and specifically, the first snap buckles 41 are disposed on the third vertical support 322. At the time, the second vertical support 313 is omitted, that is, the first side frame 31 and the second side frame 32 are both L-shaped supports. The sofa seat accessory 2 includes a second accessory 22, the second accessory 22 includes a second accessory frame 222 and the second snap buckles 42 disposed on the second accessory frame 222. The second accessory 22 is disposed on the second side frame 32 of the sofa seat 3 through the second snap buckles 42 on the second accessory 22.

Similarly, A second transverse support 223 is disposed at a position, with respect to the third transverse support 321, of the second accessory frame 222. At least one hook 51 is disposed on the third transverse support 321, at least one socket 52 is defined on the second transverse support 223, and when the second accessory 22 is connected to the sofa seat 3, the at least one hook 51 is inserted into the at least one socket 52. Similarly, the positions of the at least one hook 51 and the at least one socket 52 are further interchangeable. An arrangement of the at least one hook 51 and the at least one socket 52 makes a cross surface between the sofa seat 3 and the second accessory 22 obtain a lateral limit, which further improves a reliability of a connection between the second accessory 22 and the sofa seat 3, and provides more reliable support when the second accessory 22 is configured as an armrest of a corner sofa.

As a further improvement, fifth snap buckles 45 are disposed, with respect to the second accessory frame 222, on the first accessory frame 211. Sixth snap buckles 46 are disposed at positions with respect to the second accessory frame 222. The first accessory frame 211 and the second accessory frame 222 are detachably and rapidly connected through the fifth snap buckles 45 and the sixth snap buckles 46. Specifically, a width of the first accessory frame 211 is slightly longer than a width of the seat frame 30, and the first accessory frame 211 is connected to the seat frame 30 and extends for a certain distance to one side of the second accessory frame 222. The distance is the same as a thickness of the second accessory frame 222, the fifth snap buckles 45 are disposed at an extended section, and the sixth snap buckles 46 are disposed on a side surface of the second accessory frame 222. During assembly, assembling the first accessory 21 first, so that the first accessory frame 211 is connected to the seat frame 30, and then assembling the second accessory 22, so that the second accessory frame 222 is connected to the seat frame 30 and the first accessory frame 211.

In the embodiment, structure of each of the fifth snap buckles 45 is the same as the structure of each of the first snap buckles 41, and structure of each of the sixth snap buckles 46 is the same as the structure of each of the second sub-female buckle 42, and description is not repeated here.

As a further improvement, a third accessory (not shown) is further disposed on the other side with respect to the second accessory 22, so as to form a single-person sofa structure.

In the embodiment, the first accessory 21 is configured as the backrest of the sofa, and the second accessory 22 is configured as the armrest and the backrest of the sofa. Of course, according to different modular modes, functions of the first accessory 21 and the second accessory 22 are interchanged.

Figure 14:
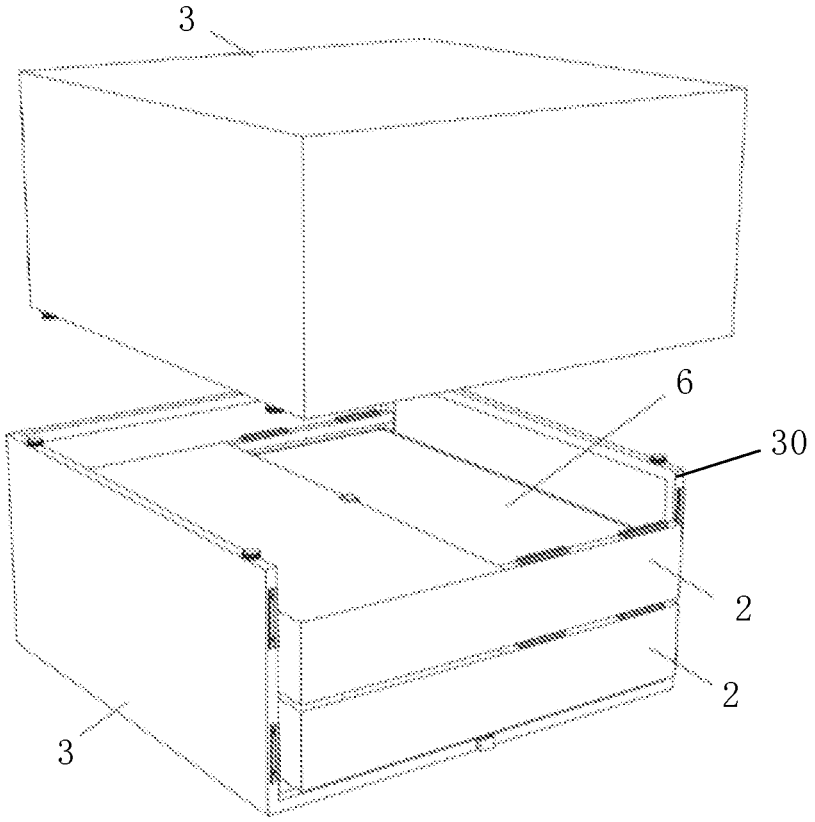
FIG. 14 is a schematic diagram of an inner space of a seat frame configured as a non-corner modular unit for packaging a sofa seat accessory according to one embodiment of the present disclosure.

As a further improvement, referring to FIG. 14, and in conjunction with FIGS. 2-4, FIG. 14 is a schematic diagram of an inner space of a seat frame 30 configured as a non-corner modular unit for packaging the sofa seat accessory according to the embodiment of the present disclosure. When the modular unit is configured as the non-corner modular unit without the armrest of the sofa, the first side frame 31 is an inverted U-shaped structure composed of the first transverse support 311, the first vertical support 312, and the second vertical support 313. One side, with respect to the bottom of the sofa seat, of the first side frame 31 is in an opening structure, which is equivalent to that after the entire seat frame 30 is wrapped with braid, there is no wrapping on a bottom surface and one side of the first side frame 31, and only four surfaces are wrapped, but support is still kept stable. Due to the support of the other three side frames, the opening structure is defined on the side, with respect to the bottom of the sofa seat, of the first side frame 31, which is conducive to better loading and unloading when configuring a frame of the sofa seat 3 as a storage space.

Specifically, a first accommodating space 301 is defined in the seat frame 30, the first accommodating space 301 is defined with respect to a shape of the sofa seat accessory 2, and the first accommodating space 301 accommodates at least one sofa seat accessory 2. As shown in FIG. 14, each first accommodating space 301 accommodates two sofa seat accessories 2. Of course, in other embodiments, thicknesses of the sofa seat accessories 2 are different, so that the number of the sofa seat accessories 2 that are accommodated in the first accommodation space 301 is different. The opening structure on the one side of the bottom of the seat frame 30 is beneficial to an insertion and a removal of the sofa seat accessories 2. Exemplarily, when packaging, first, disassembling accessories on the sofa seat 3, and turning the sofa seat 3 upside down. Then putting the sofa seat accessory 2 into the first accommodating space 301 from one side of the opening structure in a stacking manner, and stacking the remaining sofa seats 3.

Figure 15:
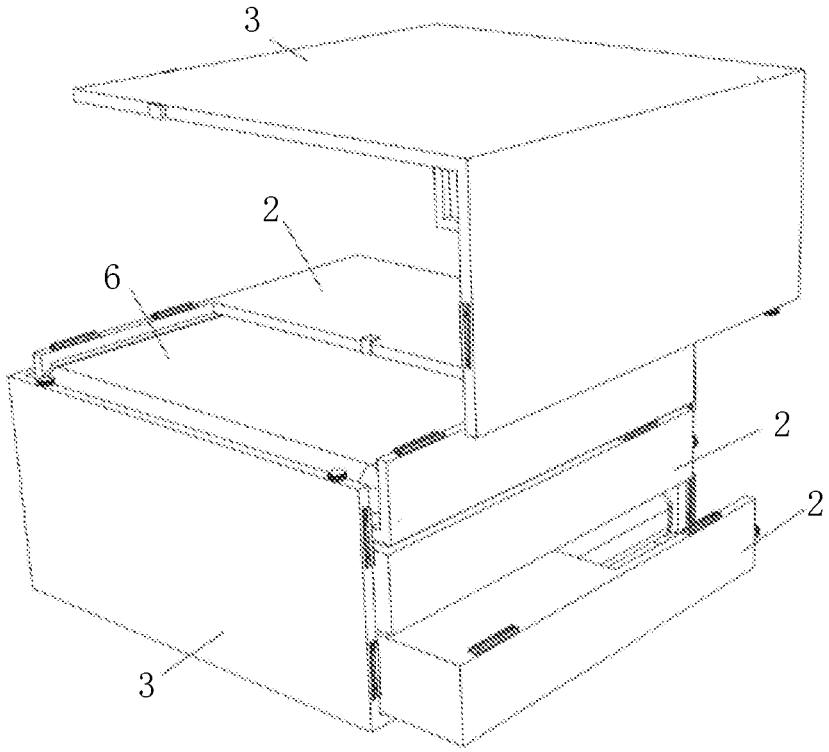
FIG. 15 is a schematic diagram of an inner space of a seat frame configured as a corner modular unit for packaging the sofa seat accessory according to one embodiment of the present disclosure.

As a further improvement, referring to FIG. 15, and in conjunction with FIGS. 5-7, FIG. 15 is a schematic diagram of an inner space of a seat frame 30 configured as a corner modular unit for packaging the sofa seat accessory 2 according to the embodiment of the present disclosure. When the modular unit is configured as the corner modular unit with the armrest of the sofa, the first side frame 31 is an inverted L-shaped structure composed of the first transverse support 311 and the first vertical support 312. One side with respect to the bottom of the sofa seat, and one side with respect to the second side frame 32, of the first side frame 31 are both in opening structures. The second side frame 32 is an inverted L-shaped structure composed of the third transverse support 321 and the third vertical support 322. It is equivalent to that after the entire seat frame 30 is wrapped with braid, there is no wrapping on a bottom surface, one side of the first side frame 31 and one side of the second side frame 32, and only three surfaces are wrapped, but the support is still kept stable. Due to the support of other two side frames which forms a triangular support, the opening structures are defined, with respect to the bottom of the sofa seat, on the one side of the first side frame 31 and the one side of the second side frame 32, which is conducive to better loading and unloading when configuring a frame of the sofa seat 3 as a storage space.

Specifically, a first accommodating space 301 is defined in the seat frame 30, the first accommodating space 301 is defined with respect to a shape of the sofa seat accessory 2, and the first accommodating space 301 accommodates at least one sofa seat accessory 2. As shown in FIG. 15, each first accommodating space 301 accommodates three sofa seat accessories 2. The opening structures on two sides of the bottom of the seat frame 30 are beneficial to an insertion and a removal of the sofa seat accessories 2. Exemplarily, when packaging, first, disassembling accessories on the sofa seat 3, and turning the sofa seat 3 upside down. Then putting the sofa seat accessory 2 into the first accommodating space 301 from one side of the opening structure in a stacking manner, the other sofa seat 3 with the same structure is directly covered on the sofa seat 3 at the bottom, and an overall height is not increased.

Based on above, an inside of the sofa seat 3 in the embodiment has the first accommodating space 301 for accommodating the sofa seat accessories 2. When packaging, an overall packaging volume is reduced, which is beneficial to transportation and packaging.

Figure 16:
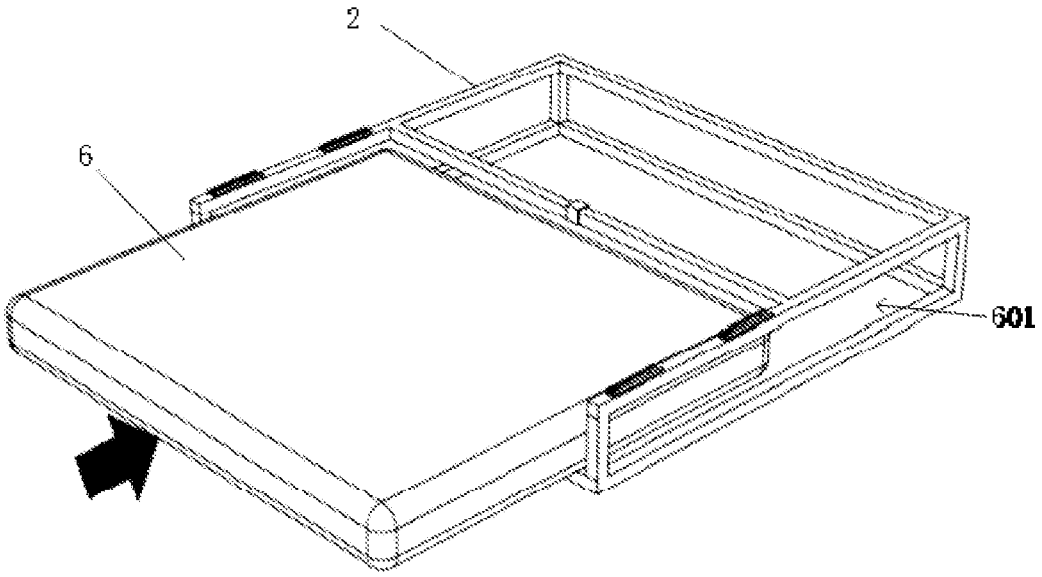
FIG. 16 is a structural schematic diagram of an inner space of the sofa seat accessory for ensuring a seat cushion according to one embodiment of the present disclosure.

As a further improvement, as shown in FIG. 16, in the embodiment, the sofa further includes a seat cushion 6, and a second accommodating space 601 is defined in the sofa seat accessory 2 for accommodating the seat cushion 6. The seat cushion 6 is inserted into the second accommodating space 601. In combination, when packaging, first, inserting the seat cushion 6 into the second accommodating space 601 of the sofa seat accessory 2, then putting the sofa seat accessories 2 into the first accommodating space 301 of the sofa seat 3 through stacking the sofa seat accessories 2 in sequence, finally, covering the other sofa seats 3 on the bottom sofa seats 3.

Figure 17:
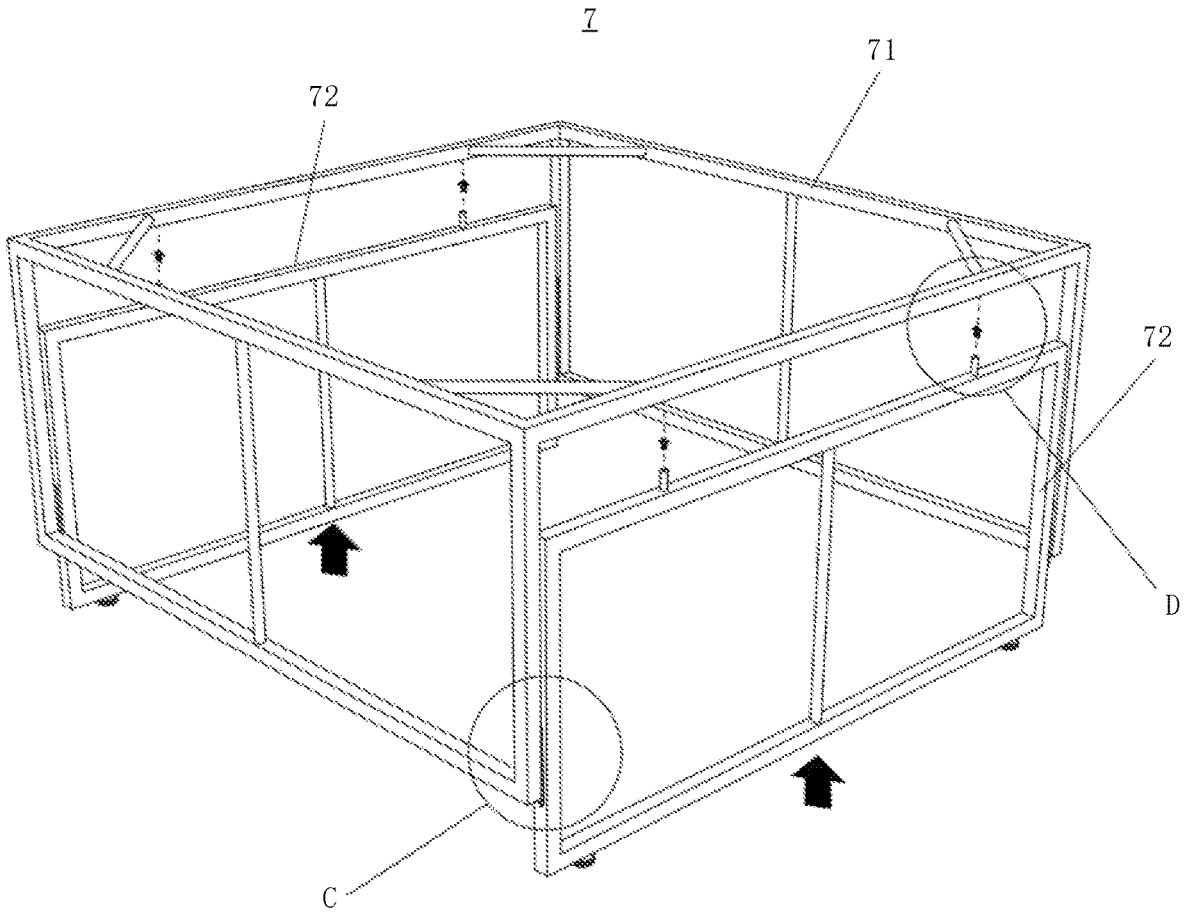
FIG. 17 is a schematic diagram of an assembly of a tea table assembly according to one embodiment of the present disclosure.
Figure 18:
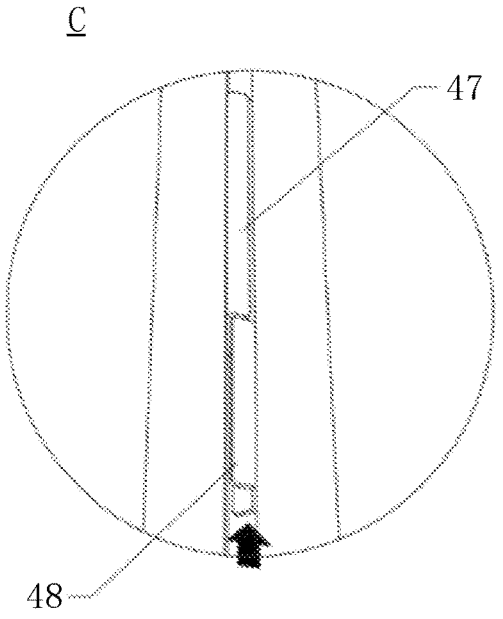
FIG. 18 is an enlarged schematic diagram of portion C in FIG. 17.
Figure 19:
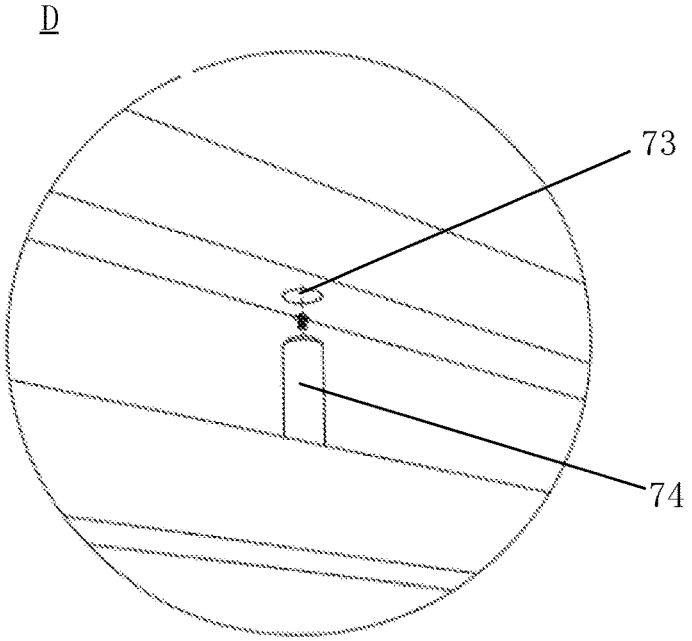
FIG. 19 is an enlarged schematic diagram of portion D in FIG. 17.

In the embodiment, as shown in FIGS. 17-19, FIG. 17 is a schematic diagram of an assembly of a tea table assembly according to an embodiment of the present disclosure. FIG. 18 is an enlarged schematic diagram of part C in FIG. 17. FIG. 19 is an enlarged schematic diagram of part D in FIG. 17. Based on FIG. 17, in the embodiment, the sofa further includes a tea table assembly 7. The tea table assembly 7 includes a U-shaped main frame 71 and auxiliary frames 72 disposed on two sides of the U-shaped main frame 71. Seventh snap buckles 47 and positioning holes 73 are respectively disposed and defined on the U-shaped main frame 71. Eighth snap buckles 48 and positioning pins 74 are disposed on the auxiliary frames 72. The U-shaped main frame 71 and the auxiliary frames 72 are detachably connected through the seventh snap buckles 47, the eighth snap buckles 48, the positioning holes 73, and the positioning pins 74.

In the embodiment, structure of each of the seventh snap buckles 47 is the same as the structure of each of the first snap buckles 41, and structure of each of the eighth snap buckles 48 is the same as the structure of each of the second sub-female buckle 42, and description is not repeated here.

Optionally, in the embodiment, the U-shaped main frame 71 and the auxiliary frames 72 further have external wrapping, and the external wrapping is further a braid or other covering.

Figure 20:
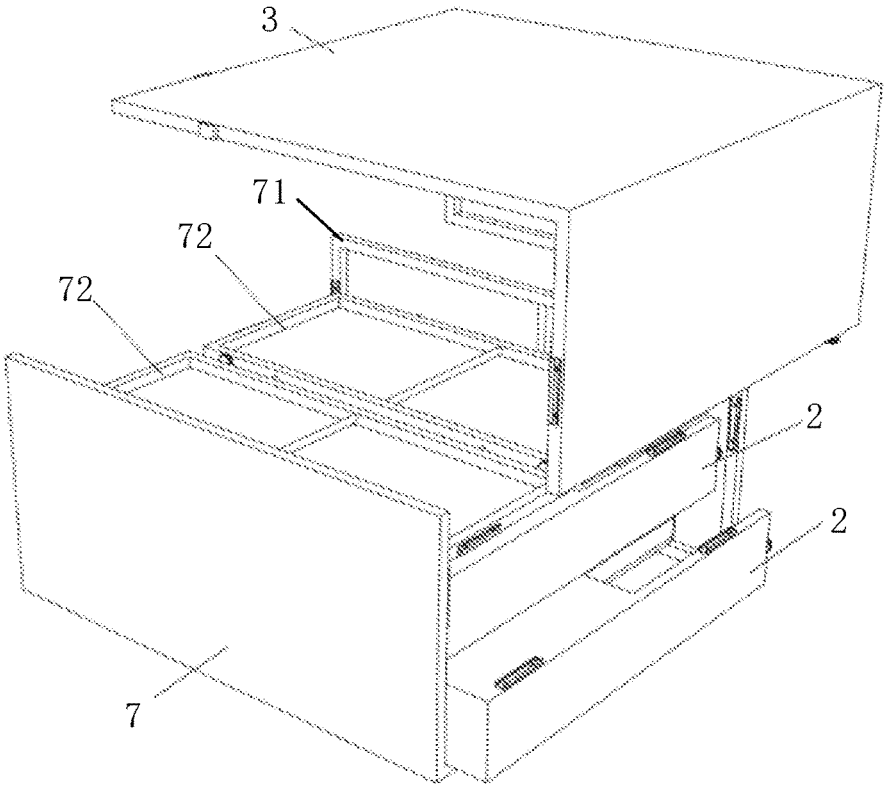
FIG. 20 is a schematic diagram of an inner space of the tea table assembly for ensuring the sofa seat accessory and an auxiliary support according to an embodiment of the present disclosure.

Furthermore, an inner space of the U-shaped main frame 71 is huge, and the inner space of the U-shaped main frame 71 is fully utilized. As shown in FIG. 20, the inner space of the U-shaped main frame 71 accommodates a plurality of the sofa seat accessories 2 and the auxiliary frames 72, and at the same time, the sofa seat 3 wrapped only on three sides is covered on an upper part of the U-shaped main frame 71.

In the embodiment of the present disclosure, the first snap buckles are disposed on at least one side of the seat frame of the sofa seat, the second snap buckles are disposed on the accessory frame of the sofa seat accessory, and when the sofa seat accessory is mounted to the sofa seat, each of the second snap buckles is matched to each of the first snap buckles to form a quick connection between the sofa seat and the sofa seat accessory. Compared with a conventional assembling method using screws, the embodiment of the present disclosure has fewer components, and the installation is more convenient and faster. At the same time, during production and assembly, the embodiment of the present disclosure reduces arrangement of holes and number of the components, and further reduces the production costs.

In another embodiment, the first accommodating space is further defined in the sofa seat for accommodating the sofa seat accessory. During packaging and transportation, the sofa seat accessory is disposed in the first accommodating space, which reduces a whole packaging volume.

In another embodiment, the second accommodating space is further defined in the sofa seat accessory. During the packaging and the transportation, the seat cushion is plugged into the second accommodating space, which further reduces the whole packaging volume.

The sofa provided by the embodiments of the present disclosure is described in detail above. Principles and implementations of the present disclosure are described with specific examples herein. The descriptions of the above embodiments are merely configured to help to understand the method and a core idea of the present disclosure. Meanwhile, for a person skilled in art, according to the idea of the present disclosure, there are changes in the specific implementations and a scope of application. In conclusion, contents of the specification are not to be construed as a limitation on the present disclosure.

What is claimed is:

1. A sofa, comprising:

a sofa seat; and a sofa seat accessory;

wherein the sofa seat comprises a seat frame, a first outer wrapping, and first snap buckles; the first outer wrapping wraps the seat frame, the first snap buckles are disposed on at least one side of the seat frame;

the sofa seat accessory is configured to be detachably mounted on the sofa seat; the sofa seat accessory comprises an accessory frame, a second outer wrapping, and second snap buckles disposed on the accessory frame; when the sofa seat accessory is mounted to the sofa seat, each of the second snap buckles is matched to each of the first snap buckles to form a quick connection between the sofa seat and the sofa seat accessory;

the seat frame of the sofa seat comprises a first side frame; the first side frame comprises a first transverse support, a first vertical support and a second vertical support; and a second transverse support is disposed at a position, with respect to the first transverse support, of the first accessory frame; at least one hook is disposed on the first transverse support, at least one socket is defined on the second transverse support, and when the first accessory is connected to the sofa seat, the at least one hook is inserted into the at least one socket.

2. The sofa according to claim 1, wherein the first side frame is disposed on one side of the seat frame, the first snap buckles are disposed on the first side frame; the sofa seat accessory comprises a first accessory, the first accessory comprises a first accessory frame and the second snap buckles disposed on the first accessory frame; the first accessory is connected to the first snap buckles on the first side frame through the second snap buckles.

3. The sofa according to claim 2, wherein the first transverse support is distal from a bottom of the sofa seat, the first vertical support and the second vertical support are respectively disposed at two ends of the first transverse support and are vertically disposed relative to the first transverse support; and the first snap buckles are disposed on the first vertical support and/or the second vertical support.

4. The sofa according to claim 3, wherein the first side frame is an inverted U-shaped structure composed of the first transverse support, the first vertical support, and the second vertical support; and one side, with respect to the bottom of the sofa seat, of the first side frame is in an opening structure.

5. The sofa according to claim 2, wherein a first accommodating space is defined in the seat frame, the first accommodating space is defined with respect to a shape of the sofa seat accessory, and the first accommodating space accommodates at least one sofa seat accessory.

6. The sofa according to claim 5, wherein the seat frame further comprises a second side frame, the second side frame is adjacent to the first side frame and is disposed at an included angle with the first side frame; the first snap buckles are disposed on the second side frame; the sofa seat accessory comprises a second accessory, the second accessory comprises a second accessory frame and the second snap buckles disposed on the second accessory frame; and the second accessory is disposed on the second side frame of the sofa seat through the second snap buckles on the second accessory.

7. The sofa according to claim 6, wherein fifth snap buckles are disposed on the first accessory frame, sixth snap buckles are disposed on the second accessory frame, and the first accessory frame and the second accessory frame are detachably and rapidly connected through the fifth snap buckles and the sixth snap buckles.

8. The sofa according to claim 1, wherein the sofa further comprises a tea table assembly, the tea table assembly comprises a U-shaped main frame and auxiliary frames disposed on two sides of the U-shaped main frame, seventh snap buckles and positioning holes are respectively disposed and defined on the U-shaped main frame, eighth snap buckles and positioning pins are disposed on the auxiliary frames, and the U-shaped main frame and the auxiliary frames are detachably connected through the seventh snap buckles, the eighth snap buckles, the positioning holes, and the positioning pins.

9. The sofa according to claim 1, wherein the sofa further comprises a seat cushion, and a second accommodating space is defined in the accessory frame for accommodating the seat cushion.

* * * * *